US011510434B2

(12) United States Patent
Blangy et al.

(10) Patent No.: US 11,510,434 B2
(45) Date of Patent: Nov. 29, 2022

(54) SMOKING ARTICLE WITH CONCENTRIC FILTER

(71) Applicant: PHILIP MORRIS PRODUCTS S.A., Neuchatel (CH)

(72) Inventors: Helene Blangy, Neuchatel (CH); Nadine Lacroix Oggier, Salgesch (CH)

(73) Assignee: Philip Morris Products S.A., Neuchâtel (CH)

( * ) Notice: Subject to any disclaimer, the term of this patent is extended or adjusted under 35 U.S.C. 154(b) by 814 days.

(21) Appl. No.: 14/401,753

(22) PCT Filed: May 29, 2013

(86) PCT No.: PCT/IB2013/054446
§ 371 (c)(1),
(2) Date: Nov. 17, 2014

(87) PCT Pub. No.: WO2013/179243
PCT Pub. Date: Dec. 5, 2013

(65) Prior Publication Data

US 2015/0144149 A1 May 28, 2015

Related U.S. Application Data

(60) Provisional application No. 61/653,550, filed on May 31, 2012.

(30) Foreign Application Priority Data

May 31, 2012 (EP) ..... 12170247

(51) Int. Cl.
*A24D 3/04* (2006.01)
*A24D 3/06* (2006.01)
(Continued)

(52) U.S. Cl.
CPC ..... *A24D 3/04* (2013.01); *A24D 3/043* (2013.01); *A24D 3/048* (2013.01); *A24D 3/066* (2013.01); *A24D 3/10* (2013.01); *A24D 3/16* (2013.01)

(58) Field of Classification Search
CPC ..... A24D 3/14; A24D 3/065; A24D 3/043; A24D 3/048; A24D 3/04
See application file for complete search history.

(56) References Cited

U.S. PATENT DOCUMENTS 4,294,265 A * 10/1981 Kassman ..... A24D 3/043 131/366
5,392,792 A * 2/1995 Banerjee ..... A24D 3/043 131/336
(Continued)

FOREIGN PATENT DOCUMENTS

DE 19925313 A1 12/2000
EA 012315 B1 9/2009
(Continued)

OTHER PUBLICATIONS

Count, M.E., "Smoke composition and predicting relationships for international commercial cigarettes smoked with three machine-smoking conditions", Jan. 26, 2005, Regulatory Toxicology and Pharmacology, 41, p. 185-227 (Year: 2005).*
(Continued)

*Primary Examiner* — Francisco W Tschen
*Assistant Examiner* — Sonny V Nguyen
(74) *Attorney, Agent, or Firm* — Mueting Raasch Group

(57) ABSTRACT

A smoking article (10) incorporates a tobacco rob (12) and a filter attached to the tobacco rod. The filter includes a concentric filter segment (20) having a central core portion (23) with sorbent material and an outer periphery layer (24) circumscribed about the central core portion. At least about 80 weight % of the sorbent in the smoking article is disposed
(Continued)

Figure 1:
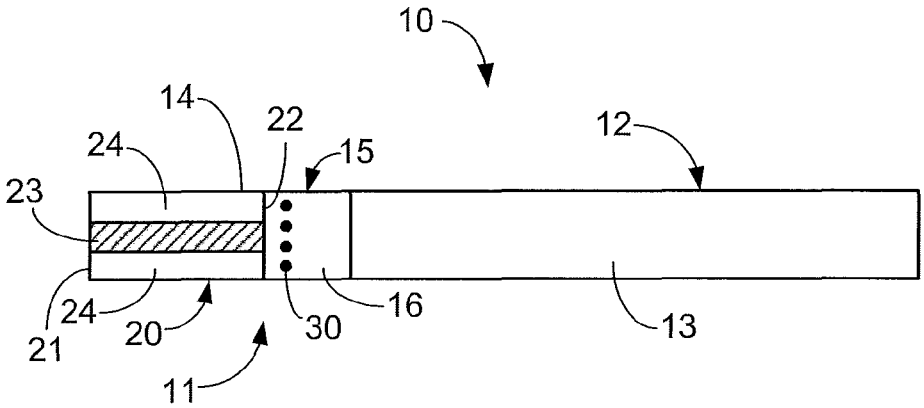

in the central core portion. The central core portion has a lower RTD than the periphery layer. A ventilation zone (30) is disposed adjacent an upstream end of the concentric sorbent segment.

14 Claims, 1 Drawing Sheet

(51) Int. Cl.
*A24D 3/16* (2006.01)
*A24D 3/10* (2006.01)

(56) References Cited

U.S. PATENT DOCUMENTS

| | | | | |
|---|---|---|---|---|
| 5,549,125 | A * | 8/1996 | White | A24D 3/04 131/336 |
| 5,622,190 | A * | 4/1997 | Arterbery | A24D 3/04 131/336 |
| 5,787,902 | A * | 8/1998 | Shepherd | A24D 3/043 131/331 |
| 2003/0140932 | A1* | 7/2003 | Seidel | A24D 3/043 131/331 |
| 2005/0066983 | A1* | 3/2005 | Clark | A24D 3/043 131/341 |
| 2006/0225753 | A1* | 10/2006 | Kaczmarek | A24B 15/282 131/334 |
| 2007/0000505 | A1* | 1/2007 | Zhuang | A24D 3/048 131/342 |
| 2007/0181141 | A1 | 8/2007 | Xue et al. | |
| 2008/0168998 | A1* | 7/2008 | Badertscher | A24D 3/043 131/365 |
| 2008/0230079 | A1 | 9/2008 | Besso et al. | |
| 2009/0044816 | A1* | 2/2009 | Rasouli | A24D 3/048 131/274 |
| 2011/0108044 | A1* | 5/2011 | Norman | A24D 3/048 131/334 |

FOREIGN PATENT DOCUMENTS

| | | | | |
|---|---|---|---|---|
| EA | 012316 | B1 | 9/2009 | |
| EA | 015119 | B1 | 6/2011 | |
| EP | 0 579 410 | B1 | 12/1996 | |
| EP | 0 658 320 | B1 | 3/1999 | |
| EP | 1 093 728 | A1 | 4/2001 | |
| EP | 1093728 | A1 * | 4/2001 | A24D 3/04 |
| EP | 1182940 | B1 | 5/2003 | |
| EP | 1848292 | B1 | 10/2015 | |
| JP | 06-098747 | A | 4/1994 | |
| JP | 07-250666 | A | 10/1995 | |
| JP | H07-278961 | | 10/1995 | |
| JP | 08-38144 | A | 2/1996 | |
| JP | 2003-500078 | | 1/2003 | |
| JP | 2012-502628 | A | 2/2012 | |
| KR | 19980081360 | A | 11/1998 | |
| WO | WO 2006/090290 | A1 | 8/2006 | |
| WO | WO 2010/032033 | A1 | 3/2010 | |
| WO | WO 2011/060008 | A1 | 5/2011 | |

OTHER PUBLICATIONS

International Preliminary Report on Patentability for PCT/IB2013/054446, dated Dec. 11, 2014 from The International Bureau of WIPO; 6 pgs.

International Search Report and Written Opinion from PCT/IB2013/054446, issued by the European Patent Office, dated Nov. 29, 2013; 10 pgs.

Japanese Office Action, including English Translation, issued by the Japanese Patent Office for JP 2017-243560; 14 pgs.

Korean Office Action for Application No. 10-2014-7031125, issued by the Korean Intellectual Property Office dated Sep. 30, 2019; 12 pgs. Including English Translation.

* cited by examiner

SMOKING ARTICLE WITH CONCENTRIC FILTER

This application is the § 371 U.S. National Stage of International Application No. PCT/IB2013/054446, filed 29 May 2013, which claims the benefit of U.S. Provisional Application No. 61/653,550, filed 31 May 2012 and European Application No. 12170247.6, filed 31 May 2012, each of which are incorporated by reference herein in their entireties.

The present disclosure relates to a smoking article with a concentric filter segment with a sorbent disposed in the core of the concentric filter segment.

Filter cigarettes typically comprise a wrapped rod of tobacco cut filler and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. In some cases, it is known to use a filter plug with a concentric core design wherein one material is used for the inner core and another material surrounds the core and forms an outer portion of the concentric filter plug.

It would be desirable to provide a novel smoking article that has an efficient sorbent containing filter segment to capture smoke constituents. It is desirable that the novel smoking article utilize a minimum amount of sorbent material to reduce cost and potentially minimize the effect on taste. Providing a novel smoking article construction that improves sorbent efficiency is particularly desirable.

According to the current disclosure, there is provided a smoking article having a tobacco rod and a filter attached to the tobacco rod. The filter includes a concentric sorbent segment having a central core portion with sorbent material and an outer periphery layer circumscribed about the central core portion. The central core portion has lower resistance to draw, a lower density, or both a lower resistance to draw and density, than the periphery layer. A ventilation zone is disposed adjacent an upstream end of the concentric sorbent segment.

Smoking articles according to the present disclosure provide an effective way to improve smoke constituent contact with the sorbent material. Smoke constituents preferentially pass through the central core portion of the concentric sorbent segment. The novel smoking article construction concentrates mainstream smoke flow through the central core portion of the concentric sorbent segment, increasing the efficiency of the sorbent material. This in turn allows for the use of less sorbent material (and associated cost) to achieve the desired level of smoke constituent capture. In addition, the use of less sorbent material in the smoking article may assist in minimizing the sorbent material's effect on the taste of the smoking article.

Smoking articles according to the disclosure include a filter attached to a tobacco rod. The filter or filter element is axially aligned with a tobacco rod. In many embodiments, the filter or filter element is joined to the tobacco rod with tipping paper. The filter or filter element can be formed of one or more segments. Preferably, the smoking article includes three filter segments in axial alignment with each other.

The filter includes a concentric filter segment. The concentric filter segment includes a central core portion with sorbent material and an outer periphery layer circumscribed about the central core portion. The outer periphery layer and the central core may be separated from one another by a permeable or, more preferably, an impermeable layer of material. The material separating the outer periphery and the central core is permeable if it has a porosity of 20 Coresta units or greater, and it is impermeable if it has a porosity of less than 20 Coresta units.

The resistance to draw (RTD) of the central core portion is less than the RTD of the periphery layer. In many embodiments the RTD of the central core portion is less than about 90% of the RTD of the periphery layer or less than about 75% of the RTD of the periphery layer or less than about 65% of the RTD of the periphery layer. In many embodiments, the RTD of the central core portion is about 10% to about 90% or about 20% to about 75%, or about 30% to about 65% of the RTD of the periphery layer. Measurement of the RTD is further discussed below.

In some embodiments the periphery layer RTD can be increased relative to the central core by increasing an amount of plastizier in the periphery layer relative to an amount of plastizer in the central core portion. In some cases, the outer periphery layer may have more than about 8 weight % pasticizer or more than about 9 weight % plastisizer. In addition, or in the alternative, the outer periphery layer may have less than about 12 weight % plasticizer. Further, in some embodiments the central core portion may also contain plasticizer. For example, the central core portion may have less than about 7 weight % plasticize or less than about 6 weight % plasticizer. In addition, or in the alternative, the central core may have greater than about 3 weight % plasticizer. The central core portion may also have a lower density than the periphery layer. In many embodiments, the central core portion has a density that is less than about 90%, less than about 75%, or less than about 65% of the density of the periphery layer.

The central core portion can have a cylindrical form. The central core can be formed of cellulose-based material and sorbent material dispersed or impregnated within in the cellulose-based material. In many embodiments the cellulose-based material is a nonwoven web of cellulosic material such as paper, for example. In other embodiments the central core may be cellulose acetate.

The term "sorbent" refers to material that captures one or more smoke constituents. The term "smoke" or "tobacco smoke" refers to the mixture of vapor and particulate phase given off as a tobacco material undergoes combustion or heating, or both combustion and heating. Sorbents include carbon (for example, activated carbon, coated carbon, beaded carbon), active aluminium, zeolites, sepiolites, molecular sieves, and silica gel, for example. In many embodiments at least about 80 weight % or at least about 90 weight %, or the entire amount (100 weight %) of total smoking article sorbent material is in the central core.

In many embodiments the smoking articles contains less than about 25 mg, less than about 15 mg, or less than about 10 mg of sorbent material. In some embodiments the smoking articles contains about 1 mg to about 25 mg, about 1 mg to about 15 mg, or about 1 mg to about 10 mg of sorbent material, such as activated carbon, for example. In many embodiments the central core contains less than about 25 mg, less than about 15 mg, or less than about 10 mg of sorbent material. In some embodiments the central core contains about 1 mg to about 25 mg, about 1 mg to about 15 mg, or about 1 mg to about 10 mg of sorbent material, such as activated carbon, for example. In many embodiments the sorbent can be incorporated within the paper forming the central core or disposed on the paper surface forming the central core. In some embodiments, the sorbent is both incorporated within the paper forming the central core and disposed on the paper surface forming the central core.

The outer periphery layer can have an annular form and surround the central core portion. The outer periphery layer can have a density that is greater than the density of the central core. In many embodiments the periphery layer does not include sorbent material. The outer periphery layer can be formed of any useful filtration material. In many embodiments the outer periphery layer is formed from cellulose acetate. In other embodiments the outer periphery layer is formed of a nonwoven web of cellulosic material such as paper.

In some embodiments the filter only includes the concentric sorbent segment. In many embodiments, the filter includes the concentric sorbent segment in axial alignment with a second filter segment separating the concentric sorbent segment from the tobacco rod. In preferred embodiments, the filter element includes the concentric sorbent segment in axial alignment and separating a second filter segment and a third filter segment. The concentric sorbent segment has an upstream end and a downstream end. The upstream end extends toward the tobacco rod.

The outer periphery layer can have an first outer diameter and the central core portion can have a second outer diameter. Preferably, the second outer diameter is at least about 40% of the first outer diameter, more preferably at least about 60%. In addition, or in the alternative, the second outer diameter is less than about 90% of the first outer diameter, more preferably less than about 80%. The second outer diameter is preferably between about 40% and about 90% of the first outer diameter, more preferably between about 60% and about 80% of the first outer diameter.

The second filter segment and the third filter segment can be formed of any useful filtration material. In many embodiments the second filter segment and the third filter segment are formed of a cellulose-based material. The cellulose-based material can be a nonwoven web of cellulosic material such as paper. In other embodiments, one or both of the second and third filter segments may be formed of cellulose acetate. In many embodiments, the second filter segment and the third filter segment are formed of uniform filtration material such as cellulose acetate tow. The second filter segment and the third filter segment can be designed to adjust the physical properties of the smoking article such as resistance to draw, for example.

A ventilation zone is disposed adjacent to the upstream end of the concentric sorbent segment. The ventilation zone admits ambient air into the smoking article and combines the admitted ambient air with mainstream smoke. The ventilation zone has an increased porosity that allows a greater amount of airflow into the device along the ventilation zone as compared to areas adjacent to the ventilation zone. The ventilation zone may be provided by a plurality of apertures or perforations formed in the tipping paper. This plurality of apertures or perforations can circumnavigate the circumference of the smoking article. In many embodiments the ventilation zone provides ambient air dilution of the mainstream smoke of at least about 30%, or at least about 40% or at least about 60%. In addition, or in the alternative, the ventilation provides ambient air dilution of less than about 90%, or less than about 80%. In some embodiments, the dilution level may be between about 30% and about 90%, between about 40% and about 90%, or between about 60% and about 80%. The term "dilution" refers to the percentage by volume of air that is included in the smoke delivered to the consumer from the mouth end of the filter with the ventilation completely open. The level of ventilation or dilution achieved by the ventilation elements can be determined using ISO test method 9512:2002.

Applicants have discovered that positioning the ventilation zone near or adjacent to the upstream end of the concentric sorbent segment can improve the efficiency of the sorbent material in the concentric sorbent segment. While not wishing to be bound by any particular theory, it is believed that positioning the ventilation zone near or adjacent to the upstream end of the concentric sorbent segment concentrates the smoke toward the central core portion and the sorbent material, as the smoke flows through the concentric filter segment.

In many embodiments the ventilation zone is disposed within about 5 mm or within about 3 mm or within about 1 mm of the upstream end of the concentric sorbent segment. In preferred embodiments, the ventilation zone is disposed within about 5 mm or within about 3 mm or within about 1 mm upstream from the upstream end of the concentric sorbent segment. In some embodiments, the ventilation zone is disposed along the length of the second filter segment separating the concentric sorbent segment from the tobacco rod. Preferably, the ventilation zone is within about 5 mm or within about 3 mm or within about 1 mm upstream from the concentric sorbent segment, for example within the second filter segment. In some embodiments the ventilation zone is located in at least two positions along the length of the filter to further guide the mainstream smoke through the central core portion of the concentric sorbent segment. For example, a first ventilation zone can be within about 5 mm or within about 3 mm or within about 1 mm of the upstream end of the concentric sorbent segment (for example, any of these distances upstream of the upstream end of the concentric sorbent segment) and a second ventilization zone can be downstream of this first ventilation zone, in the concentric sorbent segment.

In many embodiments the overall length of smoking article is between about 70 mm and about 130 mm, or about 85 mm. The external diameter or outer periphery layer first outer diameter of smoking article can be between about 5.0 mm and about 8.5 mm, or between about 5.0 mm and about 7.1 mm for slim sized smoking articles or between about 7.1 mm and about 8.5 mm for regular sized smoking articles.

The overall length of the filter of the smoking article can be between about 18 mm and about 36 mm, more preferably about 27 mm. The length of individual filter segments (i.e., concentric sorbent segment, second filter segment, and third filter segment) can vary depending if only the concentric sorbent segment is present or if the second filter segment is also present or if the third filter segment is also present. The second and third filter segments is preferably between about 5 and about 10 mm and the concentric sorbent segment is preferably between about 8 to about 16 mm.

The resistance to draw (RTD) of the smoking articles of the present disclosure can vary. In many embodiments the RTD of the smoking article is between about 90 to 130 mm $H_2O$. The RTD of a smoking article refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002. The RTDs of the outer periphery layer and the central core portion can be tested by first separating the concentric sorbent segment from the rest of the filter. The RTD of the outer periphery layer of the concentric sorbent segment can then be tested by blocking off the upstream end of the central core portion of the concentric sorbent segment and utilizing the RTD test method described above. The RTD of the central core portion of the concentric sorbent segment can be tested by blocking off the upstream end of the outer periphery layer of the concentric sorbent segment and utilizing the RTD test method described above. The portions of the concentric sorbent segment can be blocked off with an impermeable material, for example an impermeable adhesive.

Smoking articles according to the present invention may be packaged in containers, for example in soft packs or hinge-lid packs, with an inner liner coated with one or more flavourants.

Figure 2:
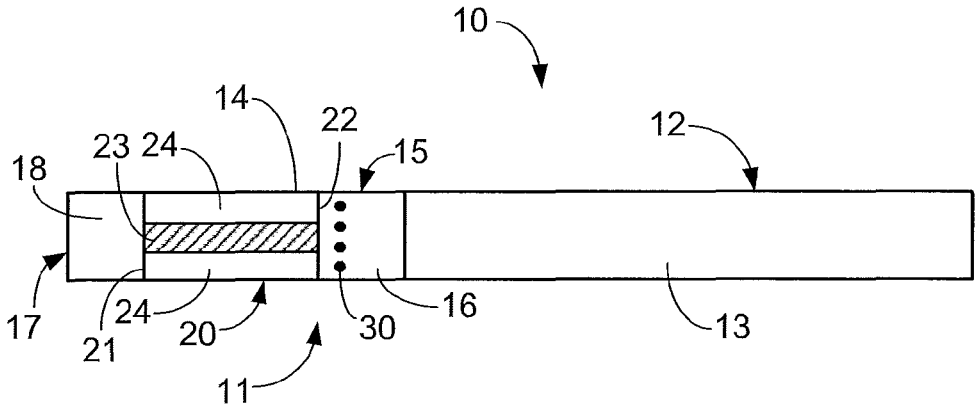

The disclosure will be further described, by way of example only, with reference to the accompanying drawings, in which:

FIG. 1 shows a schematic cross section view of a smoking article according to the present disclosure having two filter segments; and FIG. 2 shows a schematic cross section view of a smoking article according to the present disclosure having three filter segments.

The smoking article 10 shown in FIG. 1 and FIG. 2 includes a tobacco substrate or tobacco rod 12 attached to an axially aligned filter 11. The filter 11 is joined to the tobacco rod 12 with tipping paper 14. The tobacco rod 12 includes tobacco material 13 such as cut tobacco shreds.

FIG. 1 illustrates a smoking article 10 having a concentric sorbent segment 20 and a second filter segment 15 in axial alignment with each other. The second filter segment 15 separates the tobacco rod 12 from the concentric sorbent segment 20. The concentric sorbent segment 20 has an upstream end 22 and a downstream end 21. The upstream end 22 extends toward the tobacco rod 12.

FIG. 2 illustrates a smoking article 10 having three filter segments where the concentric sorbent segment 20 is in axial alignment and separates a second filter segment 15 and a third filter segment 17. The concentric sorbent segment 20 has an upstream end 22 and a downstream end 21. The upstream end 22 extends toward the tobacco rod 12.

A ventilation zone 30 is disposed adjacent to the upstream end 22 of the concentric sorbent segment 20. The ventilation zone 30 is provided by a plurality of apertures or perforations formed in tipping paper 14 that is otherwise generally air impermeable. The ventilation zone 30 can circumnavigate the circumference of the smoking article 10. Positioning the ventilation zone 30 near or adjacent to the upstream end 22 of the concentric sorbent segment 20 appears to improve the efficiency of the sorbent material in the concentric sorbent segment 20. The ventilation zone 30 can be disposed within about 5 mm or within about 3 mm of the upstream end 22 of the concentric sorbent segment 20. In preferred embodiments, the ventilation zone 30 is disposed within about 5 mm or within about 3 mm upstream from the concentric sorbent segment 22 and along the length of the second filter segment 15, as illustrated.

The filter 11 includes a concentric sorbent segment 20. The concentric sorbent segment 20 includes a central core portion 23 including a sorbent material and an outer periphery layer 24 circumscribed about the central core portion 23. The central core portion 23 has a lower resistance to draw or density than the periphery layer 24, as described above.

EXAMPLES

A smoking article prototype (Example A) and a reference smoking article (Comparative Example) were similarly constructed except for the location of the ventilation zone. Example A and Comparative Example were then tested and the results are reported below.

Example A and the Comparative Example were constructed as shown in FIG. 2 herein except the location of the ventilation zone was altered in the Comparative Example. The concentric sorbent segment included a central core portion formed of paper containing 8.4 mg of activated carbon. The periphery layer was formed of cellulose acetate and the second and third filter segments were formed of cellulose acetate. The central core portion exhibited an RTD of 780 mm WG and the periphery layer exhibited an RTD of 1600 mm WG. The concentric sorbent segment had a length of 12 mm and the second and third filter segments each had a length of 7.5 mm.

Example A had ventilation located on the second filter segment and 2.5 mm from the upstream end of the concentric sorbent segment. Comparative Example had the ventilation zone located on the concentric sorbent segment and 4.5 mm from the downstream end of the concentric sorbent segment. Table 1 reports selected physical and analytical results for the Example A and Comparative Example.

TABLE 1

| | Filter Diluation (%) | Total RTD ($mmH_2O$) | Filter RTD ($mmH_2O$) | TAR (mg/cig) | Smoke nicotine (mg/cig) | CO (mg/cig) |
|---|---|---|---|---|---|---|
| Ex. A | 49 | 96 | 96 | 5.7 | 0.48 | 8.2 |
| Comp. Ex. | 45 | 126 | 104 | 6.4 | 0.59 | 8.1 |

Smoke constituent analysis was performed on both Example A and Comparative Example to evaluate the impact of the ventilation position on the carbon efficiency. Table 2 reports the means and standard deviations for both Example A and Comparative Example for analysed smoke constituents.

TABLE 2

| Smoke constituent | | | Standard Deviation | | Diff |
|---|---|---|---|---|---|
| (ug/mg SN) | Comp | Ex. A | Comp | Ex. A | (Comp-Ex. A) |
| Propionaldehyde | 62.8 | 52.4 | 2.3 | 4.9 | −10.3 |
| Butyraldehyde | 47.1 | 41.5 | 2.2 | 3.0 | −5.6 |
| Crotonaldehye | 27.9 | 25.6 | 1.72 | 3.4 | −2.3 |
| Acetone | 312.7 | 268.7 | 15.8 | 26.7 | −44.0 |
| Methylethylketone | 75.2 | 66.7 | 3.7 | 6.3 | −8.5 |
| Acetaldehyde | 772.2 | 637.8 | 27.5 | 42.3 | −134.4 |
| Acronlein | 71.5 | 58.4 | 3.7 | 7.0 | −13.1 |
| Formaldehyde | 41.7 | 35.5 | 2.5 | 3.3 | −6.1 |
| 1,3-Butadien | 72.2 | 58.6 | 3.7 | 3.3 | −13.6 |
| Benzene | 67.5 | 57.0 | 2.7 | 2.9 | −10.4 |
| Isoprene | 577.8 | 440.3 | 36.3 | 28.2 | −137.5 |
| Acrylonitrile | 13.6 | 11.5 | 0.6 | 1.1 | −2.0 |
| Toluene | 104.2 | 94.3 | 5.6 | 5 | −9.9 |

The results reported above indicate that the position of the ventilation zone upstream or near the upstream end of the concentric sorbent segment enhances the efficiency of the sorbent in the concentric filter segment.

The invention claimed is:

1. A smoking article comprising:

a tobacco rod;

a filter attached to the tobacco rod by tipping paper, the filter comprising;

a concentric sorbent segment including a central core portion and an outer periphery layer circumscribed about the central core portion, the outer periphery comprising filtration material formed of cellulose acetate, the central core portion being formed of paper and comprising a sorbent material comprising carbon material impregnated in the paper, the outer periphery layer and the central core portion being separated by an impermeable layer of material, the central core portion having a resistance to draw that is from 20% to 75% of a resistance to draw of the outer periphery layer, at least 80 weight % of the sorbent material in the smoking article is disposed in the central core portion;

a second filter segment axially aligned with and between the tobacco rod and both of the central core portion and the outer periphery layer of the concentric sorbent segment; and a ventilation zone disposed upstream and within 3 mm of an upstream end of the concentric sorbent segment, the ventilation zone upstream and within 3 mm of the upstream end providing a dilution level of about 30% to 90%, the ventilation zone comprising a plurality of apertures or perforations formed in the tipping paper, wherein the ventilation zone is disposed along a length of the second filter segment.

2. A smoking article according to claim 1 wherein the concentric sorbent segment separates a third filter segment from the second filter segment.

3. A smoking article according to claim 2 wherein the third filter segment comprises cellulose acetate tow and the second filter segment comprises cellulose acetate tow.

4. A smoking article according to claim 1 wherein the central core portion has a lower density than the outer periphery layer.

5. A smoking article according to claim 1 wherein the smoking article comprises less than 25 mg of sorbent material.

6. A smoking article according to claim 1 wherein the sorbent material comprises activated carbon.

7. A smoking article according to claim 1 wherein the smoking article comprises less than 15 milligrams of activated carbon.

8. A smoking article according to claim 1 wherein the entire amount of the sorbent material in the smoking article is disposed in the central core portion of the smoking article.

9. A smoking article according to claim 1 further comprising a second ventilation zone disposed along the concentric sorbent segment.

10. A smoking article comprising:

a tobacco rod;

a filter attached to the tobacco rod by tipping paper, the filter comprising:

a concentric sorbent segment including a central core portion being formed of paper and comprising a sorbent material comprising activated carbon and an outer periphery layer circumscribed about the central core portion, the outer periphery layer and the central core portion being separated by an impermeable layer of material, the central core portion having a resistance to draw that is from 20% to 75% of a resistance to draw of the outer periphery layer, at least 80 weight % of the sorbent material in the smoking article is disposed in the central core portion;

a second filter segment axially aligned with and between the tobacco rod and both of the central core portion and the outer periphery layer of the concentric sorbent segment; and a ventilation zone disposed within 5 mm of an upstream end of the concentric sorbent segment, wherein the ventilation zone is disposed along a length of the second filter segment, the ventilation zone consisting of a plurality of apertures or perforations formed in the tipping paper.

11. A smoking article according to claim 10 wherein the smoking article comprises less than 15 milligrams of sorbent material.

12. A smoking article according to claim 10 wherein the filter comprises a third filter segment axially aligned with the concentric sorbent segment wherein the concentric sorbent segment separates the third filter segment from the second filter segment.

13. A smoking article according to claim 12 wherein the third filter segment comprises cellulose acetate tow and the second filter segment comprises cellulose acetate tow and the central core portion comprises a paper material impregnated with carbon material and the outer periphery layer comprises cellulose acetate tow.

14. A smoking article according to claim 10 further comprising a second ventilation zone disposed along the concentric sorbent segment.

* * * * *